US007674139B2

(12) United States Patent
Liao et al.

(10) Patent No.: US 7,674,139 B2
(45) Date of Patent: Mar. 9, 2010

(54) ELECTRICAL CONNECTOR WITH IMPROVED RETENTION STRUCTURES

(75) Inventors: Fang-Chu Liao, Tu-cheng (TW); Shuo-Hsiu Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/075,152

(22) Filed: Mar. 10, 2008

(65) Prior Publication Data

US 2008/0220655 A1 Sep. 11, 2008

(51) Int. Cl.
*H01R 13/502* (2006.01)

(52) U.S. Cl. ..... 439/701

(58) Field of Classification Search ..... 439/629, 439/70, 71, 68, 65, 83, 78, 701, 594, 717, 439/135, 940, 41
See application file for complete search history.

(56) References Cited

U.S. PATENT DOCUMENTS 3,042,895 A * 7/1962 Bonhomme ..... 439/701
4,998,887 A * 3/1991 Kaufman et al. ..... 439/78
6,679,707 B1 1/2004 Brodsky et al.
6,860,741 B2 * 3/2005 Ashman et al. ..... 439/70

* cited by examiner

*Primary Examiner*—Edwin A. Leon
(74) *Attorney, Agent, or Firm*—Andrew C. Cheng; Wei Te Chung; Ming Chieh Chang

(57) ABSTRACT

An electrical connector (100) for electrically connecting with a chip module and a printed circuit board comprises a plurality of insulative housings (1), a plurality of contacts received in the insulative housing, and a frame (2) defining an accommodating space (26) to accommodate the insulative housings. The frame defines continuous lateral walls (23) and a plurality of enhancing ribs (24) extending from the lateral walls into the accommodating space. A plurality of first rivet sections (231) are disposed on at least one of the lateral walls of the frame and the insulative housings and a plurality of first mounting holes (16) are defined in at least one of the insulative housings and the lateral walls of the frame to receive the first rivet sections. A plurality of second rivet sections (243) are disposed on at least one of the enhancing ribs of the frame and the insulative housings and a plurality of second mounting holes (17) are defined in at least one of the insulative housings and the enhancing ribs to receive the rivet sections.

13 Claims, 3 Drawing Sheets

ELECTRICAL CONNECTOR WITH IMPROVED RETENTION STRUCTURES

BACKGROUND OF THE INVENTION

1. Field of the Invention

The present invention generally relates to an electrical connector, and more particularly to an electrical connector for removably mounting a chip module to a printed circuit board.

2. Description of Related Art

Electrical connectors are widely used in computer field to realize electrical connections between chip modules and printed circuit boards because of their stable performance.

Such an electrical connector usually comprises a molded insulative housing and a plurality of contacts accommodated in the insulative housing. The insulative housing comprises opposite mating surface and mounting surface. When the electrical connector is in use, the insulative housing is firstly retained to the printed circuit board via soldering solder balls of the contacts to the printed circuit board, then the chip module is positioned to the mating surface to realize electrical contact between mating portions of the contacts and electrical pads of the chip module in one-by-one manner. Thus, the electrical connection between the chip module and the printed circuit board is realized.

However, with the development of technologies, new challenge of more stable electrical connection and higher speed of data transmission to the conventional connectors are raised. Thus, a conventional electrical connector was designed to electrically connect the chip module and the printed circuit board. The conventional electrical connector comprises a plurality of insulative housings, a plurality of contacts retained in the insulative housings and a frame capable of being riveted to the insulative housings. The frame comprises sidewalls each forming a transverse-bar retention rib extending into the frame to divide the frame into a plurality of receiving sections. Each sidewall forms a plurality of rivet sections, correspondingly, the insulative housing forms a plurality of through holes. To assemble the insulative housings to the frame, the rivet sections protrude through the through holes then are riveted by tool and become thinner and larger to contact upper surfaces of the insulative housings to retain the housings to the frame.

However, the frame only disposes rivet sections on sidewalls, the retention rib is of transverse bar shape. Limited by limited space of the retention ribs, the rivet sections cannot be disposed on the retention ribs. Therefore, the rivet sections are only disposed on the sidewalls of the frame, the insulative housings still have possibility to separate from the frame. Therefore, it is desired to provide an improved electrical connector to stress the problems mentioned above.

BRIEF SUMMARY OF THE INVENTION

Accordingly, an object of the present invention is to provide an electrical connector with improved retention structures for retaining a plurality of insulative housings together.

In order to achieve the above-mentioned object, an electrical connector for electrically connecting with a chip module and a printed circuit board comprises a plurality of insulative housings, a plurality of contacts received in the insulative housing, and a frame defining an accommodating space to accommodate the insulative housings. The frame defines continuous lateral walls and a plurality of enhancing ribs extending from the lateral walls into the accommodating space. A plurality of first rivet sections are disposed on at least one of the lateral walls of the frame and the insulative housings and a plurality of first mounting holes are defined in at least one of the insulative housings and the lateral walls of the frame to receive the first rivet sections. A plurality of second rivet sections are disposed on at least one of the enhancing ribs of the frame and the insulative housings and a plurality of second mounting holes are defined in at least one of the insulative housings and the enhancing ribs to receive the rivet sections.

Other objects, advantages and novel features of the invention will become more apparent from the following detailed description of the present embodiment when taken in conjunction with the accompanying drawings.

DETAILED DESCRIPTION OF THE INVENTION

Figure 1:
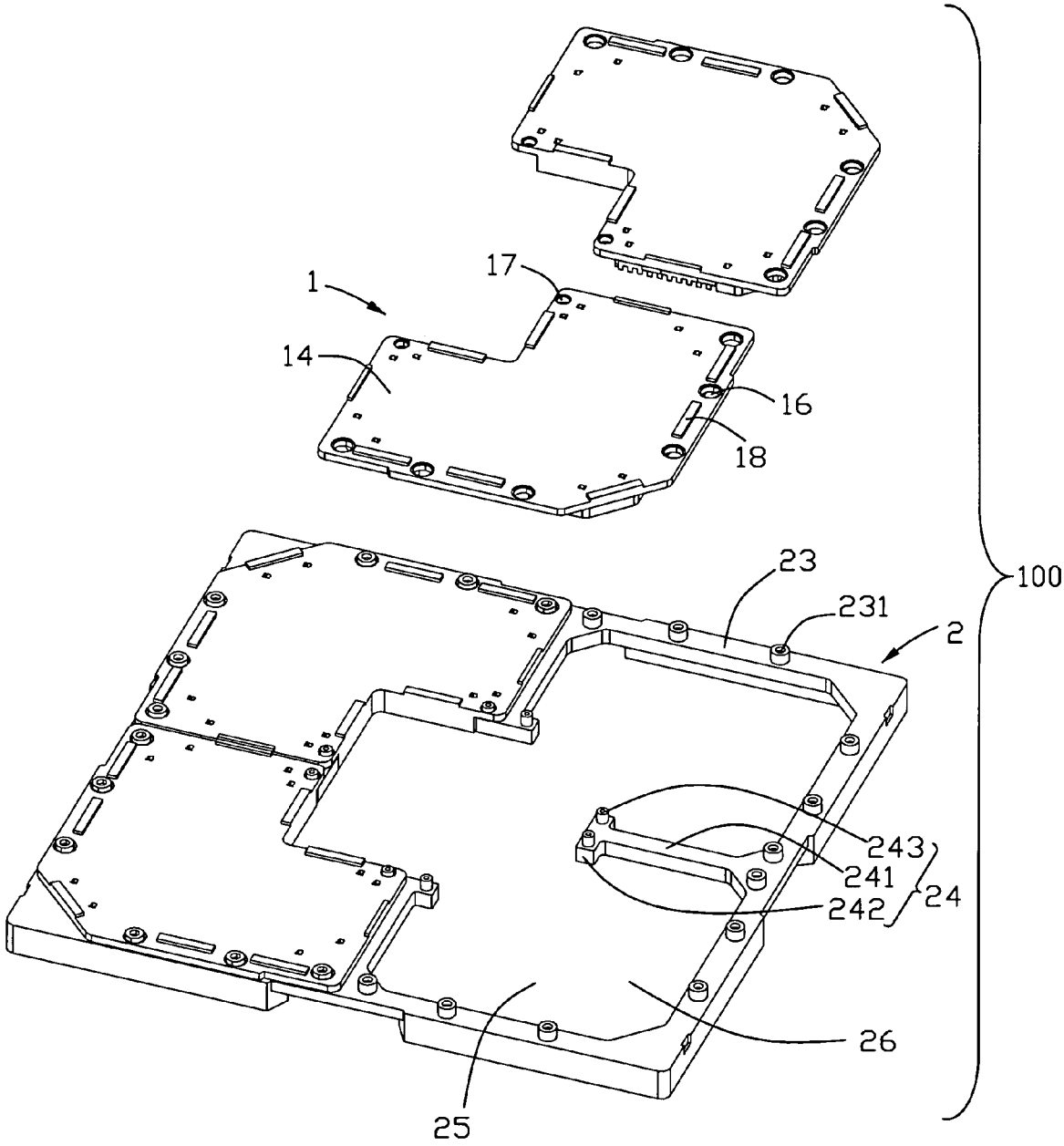
FIG. 1 is a partially, exploded perspective view of an electrical connector in accordance with the present invention.

Reference will now be made to the drawing figures to describe the present invention in detail.

Figure 2:
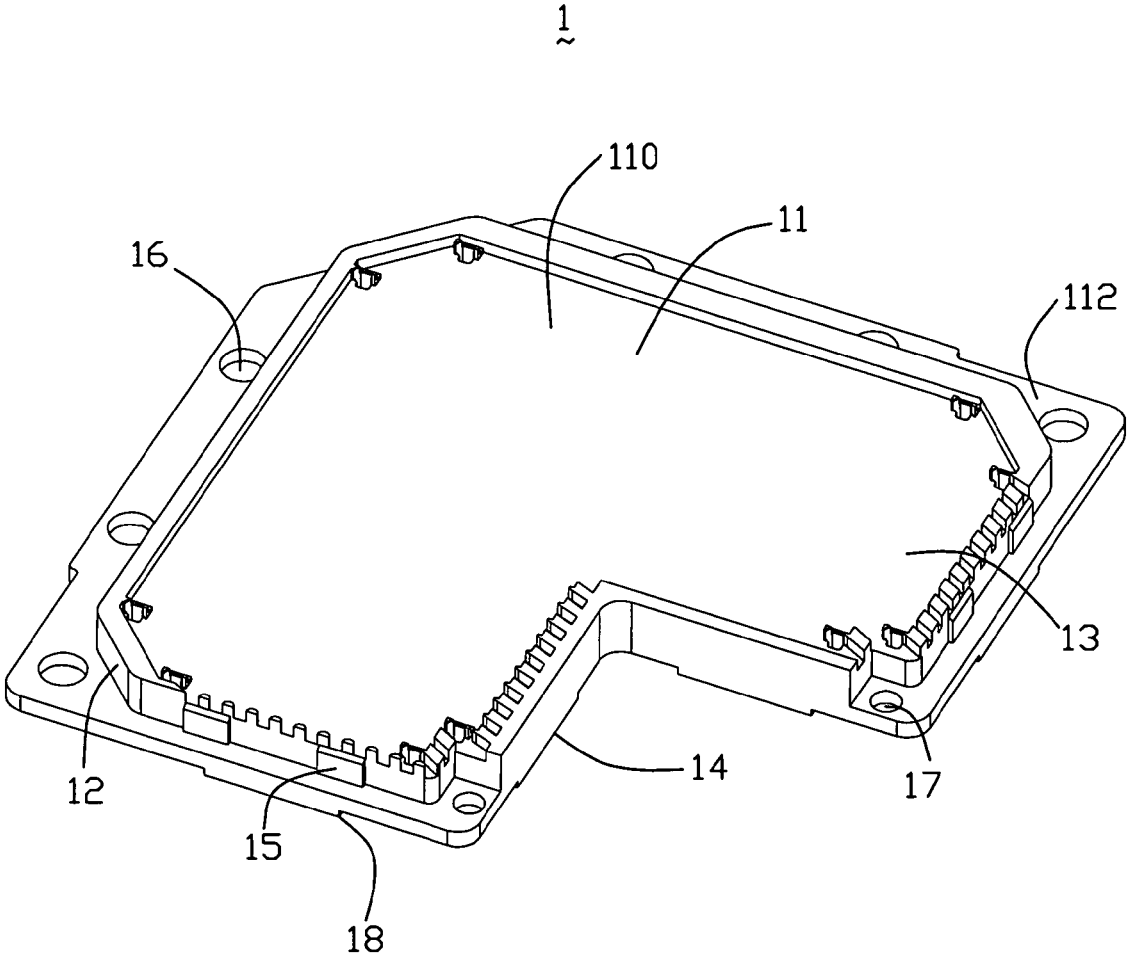
FIG. 2 is an enlarged, perspective view of an insulative housing of the electrical connector shown in FIG. 1.
Figure 3:
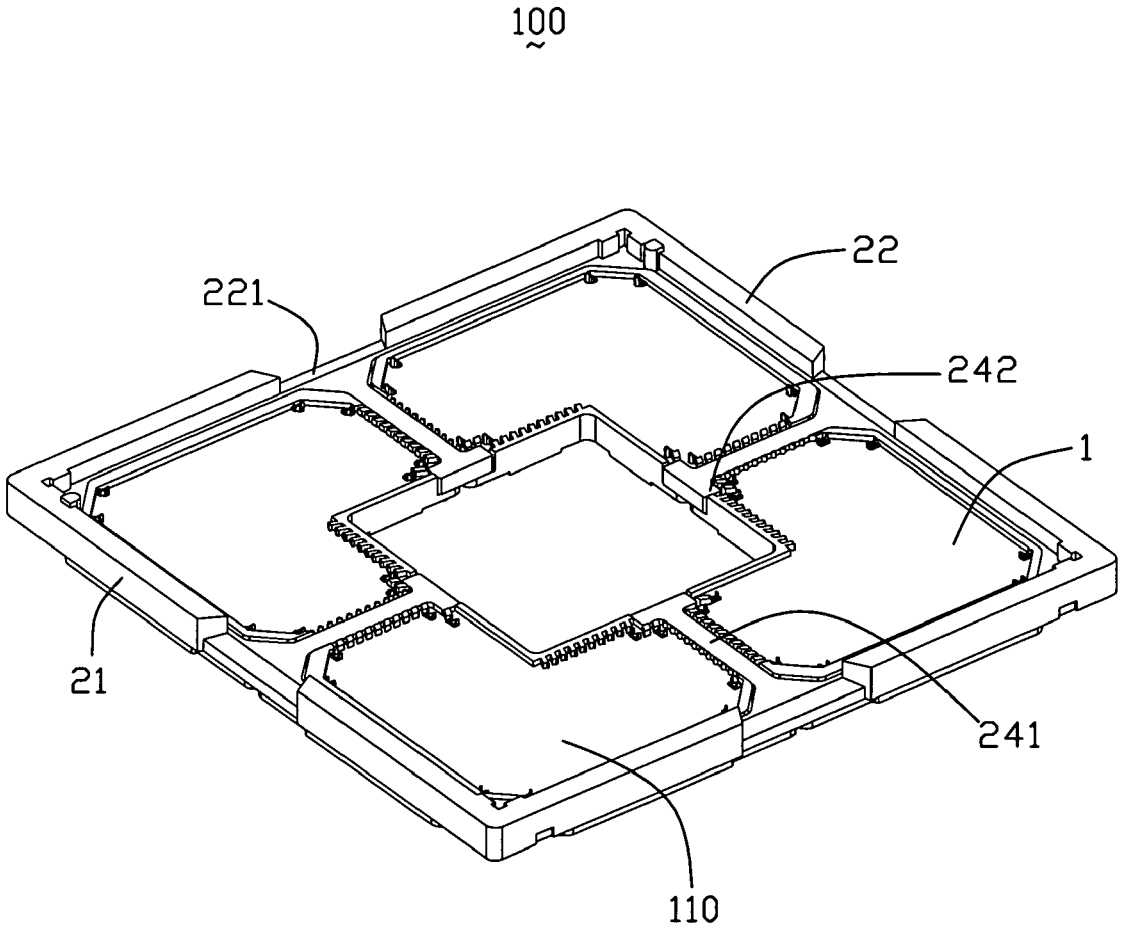
FIG. 3 is a top, assembled view of the electrical connector.

Please refer to FIGS. 1-3, an electrical connector 100 in accordance with the present invention for electrically connecting a chip module (not shown) to a printed circuit board (PCB, not shown) comprises four insulative housings 1, a plurality of contacts (not shown) received in the insulative housings 1, and a frame 2 riveted to the insulative housing 1.

The insulative housing 1 is of L-shape and comprises a bottom main portion 11, a plurality of vertical sidewalls 12 extending upwardly from the main portion 11 to form an inner space 110 for accommodating the chip module and outer flat side edges 112. The main portion 11 defines a supporting surface 13 supporting the chip module, a mounting surface 14 opposite to the supporting surface 13 for being mounted to the PCB, and a plurality of contact-receiving slots (not labeled) extending through the main portion 11 from the supporting surface 13 to the mounting surface 14 to be in matrix manner. A plurality of tubers 15 are arranged on outer periphery of the sidewalls 12 for interferentially engaging with inner periphery of lateral walls 21 of the frame 2. A plurality of first mounting holes 16 and second mounting holes 17 are defined through the side edges 112 and spaced arranged or cooperating with the frame 2. A standoff 18 is formed on the mounting surface 14 of the insulative housing 1 and located between two adjacent first mounting holes 16 to form clearance between the insulative housing 1 and the PCB for convenient solder.

The frame 2 is a rectangular block and comprises continuous lateral walls 21. Four edge-shape cutouts 221 are recessed downwardly from upper surfaces of the lateral walls 21 for picking up the chip module conveniently. A plurality of column-shape first rivet sections 231 protrude downwardly from lower surfaces of the lateral walls 21 and spaced arranged corresponding to the first mounting holes 16. A T-shape enhancing rib 24 extends from a middle of an inner edge of one lateral wall 21 toward opposite lateral wall 21 a certain distance and forms an enlarged transverse section 242 at free end thereof. Thus, a large accommodating space 26 is divided into four non-close accommodating section 25 for accommodating the four insulative housing 1. A pair of second rivet sections 243 depends downwardly from the transverse section 242 according to the second mounting holes 17. The outer diameter of each first rivet section 231 is larger than that of the second rivet section 242. Correspondingly, the diameter of the first mounting hole 16 is larger than that of the second mounting hole 17.

In assembly, the four insulative housings 1 accommodated with contacts are assembled into the accommodating sections 25 from bottom of the frame 2. The tubers 15 interferentially engage with inner periphery of the lateral walls 21, the enlarged transverse sections 242 press on the side edges 112 with the second rivet sections 243 protruding into the second mounting holes 17 and the first rivet sections 231 protruding into the first mounting holes 16. Under rivet forces exerted by tool, the first and second rivet sections 231, 243 are deformed and abut against the mounting surfaces 14 of the insulative housings 1 to form reliable interconnection between the insulative housings 1 and the frame 2. It is noted that the sidewalls 12 are categorized as the first side walls each of which directly laterally intimately confronts the corresponding lateral wall 21 or the rib 24, and the second sidewalls which do not directly laterally intimately confront the lateral wall rib but cooperate with other second sidewalls of the other housing 1 form a central opening. Understandably, in the embodiment the second sidewalls define right angle cutout in the housing 1 a top view.

In alternative embodiments, the rivet sections 231, 243 can be disposed on the insulative housings 1, while the mounting holes 16, 17 can be disposed in the frame 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for electrically connecting with a chip module and a printed circuit board, comprising:

a plurality of insulative housing;

a plurality of contacts received in the insulative housing; and a frame mounted to the printed circuit board and defining an accommodating space to accommodate the insulative housings, the frame defining continuous lateral walls and a plurality of enhancing ribs extending from the lateral walls into the accommodating space; and wherein a plurality of first rivet sections are disposed on at least one of the lateral walls of the frame and the insulative housings and a plurality of first mounting holes are defined in at least one of the insulative housings and the lateral walls of the frame to receive the first rivet sections; and wherein a plurality of second rivet sections are disposed on at least one of the enhancing ribs of the frame and the insulative housings and a plurality of second mounting holes are defined in at least one of the insulative housings and the enhancing ribs to receive the rivet sections; wherein the electrical connector comprises four insulative housings, and each insulative housing forms outer side edges standing on the lateral walls and the enhancing ribs; wherein the side edges of the insulative housing define a plurality of first and second mounting holes with different diameters, and wherein the lateral walls and the enhancing ribs form a plurality of first and second rivet sections to engage with the first and second mounting holes, respectively.

2. The electrical connector as claimed in claim 1, wherein each enhancing rib of the frame forms a pair of rivet sections riveted to connect with two different insulative housings.

3. The electrical connector as claimed in claim 1, wherein each enhancing rib is of T-shape and forms a transverse section forming a pair of second rivet sections to cooperate with two second mounting holes of two different insulative housings.

4. The electrical connector as claimed in claim 1, wherein each insulative housing forms a plurality of sidewalls to interferentially abut against the lateral walls of the frame.

5. The electrical connector as claimed in claim 1, wherein each insulative housing is of L-shape and cooperates with two lateral walls of the frame and two enhancing ribs of the frame.

6. The electrical connector as claimed in claim 5, wherein a central opening is circumscribed by the L-shape insulative housings.

7. An electrical connector comprising:

an insulative frame including four lateral walls linked with one another to define a closed confined area, and further including a plurality of ribs each extending from the corresponding lateral. wall toward a center of said frame without connecting to the other ribs; and a plurality of insulative housings assembled to the frame corresponding to corresponding areas constituted by said lateral walls and said ribs, each of said housing including a plurality of first sidewalls and second sidewalls commonly defining an upward receiving cavity; wherein each of said first sidewalls laterally intimately confronts either the corresponding lateral wall or the corresponding rib of the frame, and said second sidewalls cooperate with the other housing s to commonly form a central opening.

8. The electrical connector as claimed in claim 7, wherein said first sidewalls are equipped with flanges to stacked under the frame to fasten the housing to the frame while said some portions not.

9. The electrical connector as claimed in claim 7, wherein second sidewalls are in a right angle manner.

10. The electrical connector as claimed in claim 7, wherein said central opening is located in a center of the frame with a rectangular configuration.

11. The electrical connector as claimed in claim 7, wherein each of said housings defines a right angle cutout which said second sidewalls confront and is a part of the central opening.

12. The electrical connector as claimed in claim 7, wherein each of said rib defines a T-shaped in a top view.

13. The electrical connector as claimed in claim 7, wherein said frame includes a plurality of posts extending into corresponding through holes of the corresponding housings, respectively, for assembling to the housings to the frame.

* * * * *